United States Patent [19]

Koontz et al.

[11] 4,001,093

[45] Jan. 4, 1977

[54] METHOD OF ELECTROPLATING PRECIOUS METALS IN LOCALIZED AREAS

[75] Inventors: Donald Eldridge Koontz; Uziel Landau, both of Summit, N.J.

[73] Assignee: Bell Telephone Laboratories, Incorporated, Murray Hill, N.J.

[22] Filed: Aug. 6, 1975

[21] Appl. No.: 602,254

[52] U.S. Cl. ..... 204/15; 204/43 G; 204/46 G; 204/47; 204/275

[51] Int. Cl.[2] ..... C25D 5/02

[58] Field of Search ..... 204/15, 46 R, 46 G, 204/47, 43 G, 43 N, 237, 238, 239, 275, 276

[56] References Cited

UNITED STATES PATENTS

| | | | |
|---|---|---|---|
| 2,088,498 | 7/1937 | Tull | 204/239 |
| 3,644,181 | 2/1972 | Donaldson | 204/15 |
| R28,267 | 12/1974 | Rackus et al. | 204/15 |

OTHER PUBLICATIONS

Frederick A. Lowenheim, "Modern Electroplating", pp. 208–209, (1963).

*Primary Examiner*—G. L. Kaplan
*Attorney, Agent, or Firm*—Walter G. Nilsen

[57] ABSTRACT

A method of electroplating precious metal in localized areas. The deposits obtained are usually nonuniform and limited to only those areas where coating is actually required thus offering considerable economic savings. The method uses shaped anodes approaching the cathodes very closely, high parallel flow rates of electrolyte and high current densities of at least 100 milliamperes per cm.$^2$ in order to electroplate the precious metal quickly. The preferred precious metal is gold. The method is applied to the coating of electronic circuits and components such as connectors and switches.

17 Claims, 11 Drawing Figures

METHOD OF ELECTROPLATING PRECIOUS METALS IN LOCALIZED AREAS

BACKGROUND OF THE INVENTION

1. Field of the Invention

The invention relates to a process for electroplating precious metals such as a gold and alloys.

2. Description of the Prior Art

Precious metal electroplating processes such as gold electroplating processes have many important industrial applications, including production of jewelry, optical devices, as well as the production of electronic circuits and components. To simplify discussion, gold electroplating will be used as a concrete example. However, the discussion applies equally well to other precious metals such as rhodium, palladium, iridium and platinum. In recent years, the use of gold in such industrial applications has been increasing very rapidly. There are several advantages to the use of gold. First of all, it does not form a surface insulating film such as an oxide film. For this reason, gold has a high surface luster which is quite attractive when used in jewelry articles. For the same reason, the optical reflection properties of gold are attractive, which makes its use in optical devices highly desirable. Again, for the same reason, its use in electric circuits and components is highly desirable because surface contact to gold usually has low electrical resistance.

Gold also has the advantage of being chemically inert. This is due to the fact that no surface insulating layer is formed on gold. The use of gold often increases the lifetime and reliability of devices and articles since gold is not affected by many chemicals and adverse conditions of temperature and humidity. A particular case in point is the production of integrated electronic circuits. Here quite thin and narrow conducting paths are required. Many metals (i.e., copper) might be satisfactory as far as electrical conductivity is concerned, but they rapidly degrade with time. Gold has the advantage of being inert, and also has quite high electrical conductivity.

Because of its excellent electrical contact properties, gold is often used in electrical connectors, switches and relays. By the addition of small amounts of various elements (for example, arsenic, cobalt, nickel), gold can be made quite hard and resistant to abrasion. For the above reasons, and because of the extensive growth of the integrated circuit industry, the industrial use of gold has increased tremendously in recent years. This fact, together with the high and increasing cost of gold, has made it highly desirable to use gold in as efficient a manner as possible. Particularly significant is the development of processes which deposit gold only in the particular areas where it is required, and not in areas where it is not required. This type of process is referred to here as selective gold electroplating.

Several processes have been described for limiting the area of electroplating. For example, in U.S. Pat. No. 3,051,632 issued Aug. 28, 1962 to M. A. Dike, a copper electroplating process is described for building up the thickness of a copper tubing elbow. In this procedure only the area where copper electroplating is desired is immersed in the electroplating solution. This procedure may be quite satisfactory for building up the thickness of tubes, but is usually not applicable to gold plating intricate electronic components. Procedures are also known for producing pipe couplings by electrodeposition on a core (see, for example, U.S. Pat. No. 2,181,257 issued Nov. 28, 1939 to A. C. Arbogast), but again such a procedure is not suitable for electroplating gold on various devices. Other references having to do with electroplating are U.S. Pat. No. 2,229,077 issued Jan. 21, 1941 to W. H. Hammond et al., and 2,358,104 issued Sep. 12, 1944 to A. C. Scavullo. Plating of gun barrels is described in U.S. Pat. No. 2,780,019 issued Feb. 5, 1957 to G. C. Sullivan. A procedure for electroforming hollow bodies is described in U.S. Pat. No. 2,879,209 issued Mar. 24, 1959 to Samuel Fialkoff.

SUMMARY OF THE INVENTION

The invention is a process for producing precious metal platings of high quality at very high rates in which the precious metal is deposited with a particular (usually nonuniform) distribution on the surface being electroplated. Included in such distributions are areas of highly uniform distribution adjacent to areas of minimum metal-plating thickness. The invention is carried out under certain conditions where electrode geometry predominantly determines the distribution of precious metal on the surface being plated. Particularly significant is the observation that high flow rates parallel to the surface being plated result in metal platings of high quality. Parallel flow rates greater than about 50 cm/sec are preferred for this reason. Certain limitations on electrode geometry are also preferred. The closest spacing between anode and any portion of the cathode submerged in the bath should be less than 0.5 inch and the ratio of closest spacing between anode and any portion of the cathode submerged in the bath and greatest spacing between anode and any portion of the cathode submerged in the bath should be at least 2:1. Other preferred conditions including bath composition and relation between plating rate and flow rate for various bath compositions are described below. Although the invention is applicable to a large variety of metals it presents exceptional advantages where the cost of the metal is high, such as the precious metals (atomic numbers 44 – 47 and 76 – 79). Gold and platinum are particularly important because of their extensive use for electrical contacts. Gold plating procedures carried out in accordance with the invention permit rapid plating with the gold plating concentrated in the areas required for a particular application. The resulting platings are of high quality which is essentially pore free.

Such platings, for example, are smooth, free of nodules, pits, voids, with uniform profiles along the length of the cell. The invention permits plating at different thicknesses at different places at the same time without using mechanical masking which is often inconvenient (especially on curved surfaces) and leads to less desirable plating characteristics. Both soft and hard gold platings may be produced in accordance with this invention. Particular cell designs for use in the inventive procedure are also described.

DETAILED DESCRIPTION

Figure 1:
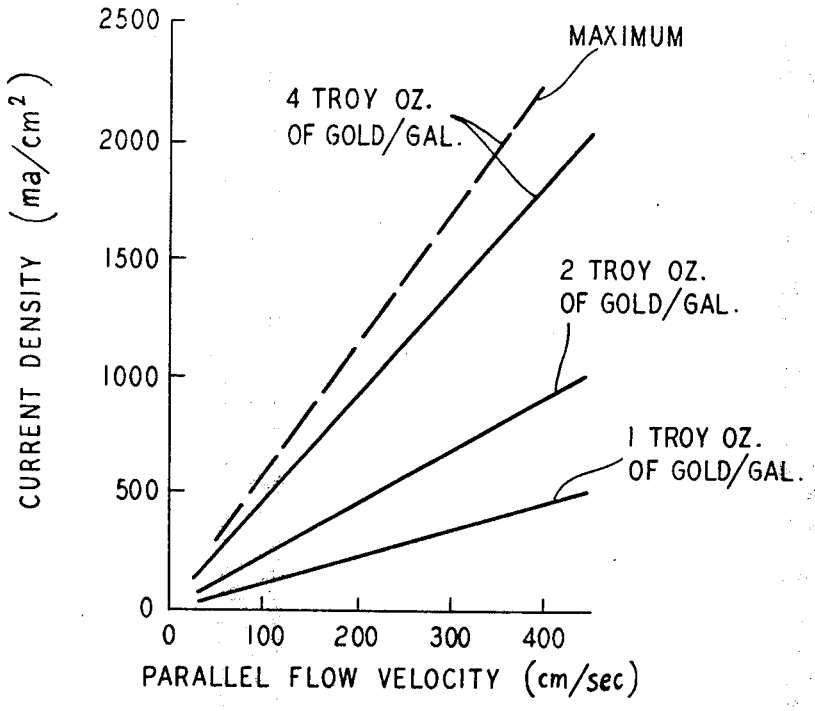
FIG. 1 is a graph showing for several gold bath compositions, on coordinates of parallel flow velocity in units of cm/sec vs current density in units of $mA/cm^2$ the relationship between plating rate and parallel flow rate which results in high quality gold platings.

The invention is grounded on the discovery that under specific conditions of plating cell geometry, flow conditions of the plating bath, electrolyte bath composition and plating current, a predetermined distribution of metal plating can be put down on a surface. The object of the particular plating cell geometry to be described below is to achieve a predetermined nonuniform current flow from anode to cathode and to maximize the flow of the plating bath parallel to the surface being plated for a given volumetric flow of plating solution. The relative spacing of the electrodes is one aspect of the plating cell geometry. Generally, the electrodes should be close together so as to obtain high current densities for rapid plating and also to obtain large variations in relative distance between individual points on the electrodes. This distance between individual points on the electrode (henceforth called the electrode separation distance) is the distance between individual points on the surface being plated to a point on the anode. For best results, the minimum electrode separation distance should be between about 0.010 and 0.5 inches. The lower limit is set to provide adequate parallel flow rate without excessively high pressures. The range from 0.050 and 0.150 inches usually provides a reasonable compromise between parallel flow rate and plating distribution. These short minimum separation distances lead to low ohmic drop between anode and cathode and permits use of plating solutions with less conducting salts.

For highly nonuniform metal platings, to product selectivity, the relative variations in electrode separation distances should be large. For example, if it is desired to concentrate the plated metal at the center of a flat surface, the anode should be shaped so that the electrode separation distance is very small where plating concentration is desired and large where little or no plating is desired. Relative spacings may be achieved both by the shape of the surface being plated and also be a particular shape of the anode. The short minimum electrode separation distances mentioned above are necessary so that these large distance variations may be achieved by reasonable shapes of the anode. For purposes of this invention, these relative distances (shortest electrode separation distance and longest separation distance) should be at least in the ratio 2:1. Larger ratios are preferred (5:1 or 10:1 or 100:1 or even larger) because in many applications of the inventive process highly nonuniform platings are desirable. It should be recognized that regions of highly uniform plating may be required adjacent to regions of minimum plating. In this case, the electrode separation distance might be nearly constant and small over one region of the surfaces being plated (where uniform plating is desired) and be large where minimum plating is desired. Also, insulating material cathode holder and walls of the cell may be shaped to minimize plating in prescribed areas of the surface to be plated.

The invention is applicable to a large variety of metals but most advantageous for precious metals because of cost savings. Gold and platinum are particularly important because of their extensive use as electrical contact materials. To facilitate a concrete discussion, much of the discussion is carried out in terms of gold.

Various flow characteristics may be used in the practice of the invention. However, it is found that the most efficient flow characteristics are obtained by using high flow rates parallel to the surface being plated. Such flow characteristics are found to permit very rapid plating rates and insure that electrode geometry has a dominant influence on the distribution of gold plating of the surface being plated. Particularly good gold platings are obtained for parallel flow rates above about 50–100 cm/sec. It should be recognized that preferred parallel flow rates depend on other parameters of the process such as bath concentration (including gold ions and supporting electrolyte), current density, electrode geometry, etc. However, parallel flow rates greater than about 1000 cm/sec, although generally desirable, are usually not worth the effort and inconvenience for the gains obtained. Also, possible cavitation occurring at very high flow rates may cause problems. Similarly, plating rate as expressed in terms of current density may be very high but above a constant current density of 6000 mA/cm$^2$ the procedure is often difficult to control. Typically, the procedure is carried out advantageously at a current density between 100 and 2500 mA/cm$^2$. However, pulse current densities above this limit may be used advantageously in some situations. Also, it is preferred in this process to design the plating cell to increase flow rate parallel to the surface being plated for a given volume flow rate.

Although the invention may be practiced over a wide variety of conditions (composition of bath, temperature, current density, parallel flow velocity, etc.), certain conditions are preferred both for convenience and because of the high quality of gold plating obtained especially at high plating rates. These preferred conditions depend on bath composition. High plating rates are desirable especially under manufacturing conditions. However, such high plating rates yield high quality platings (pore-free, bright platings of low porosity) only under certain conditions. Many of the preferred conditions are shown in FIG. 1. This figure shows a graph of current density vs. parallel flow velocity for a number of concentrations of gold. These gold concentrations are set forth in terms of troy ounces per gallon. The gold may be contained in the aqueous bath in a variety of forms but is usually in the form of a gold cyanide complex ion such as potassium gold cyanide. Although higher concentrations of gold than 4 troy ounces per gallon are useful in the practice of the invention, generally such high concentrations are inconvenient because of possible precipitation of gold and other salts out of the gold plating bath. The curve in FIG. 1 marked maximum shows for this composition the maximum combination of current density and parallel flow velocity which yield reasonably good gold platings. This curve may be expressed analytically as current density in $mA/cm^2$ equals 5.7 times parallel flow velocity in cm/sec. The curve below this maximum curve (solid curve marked 4 troy ounces of gold per gallon) shows the preferred conditions for concentration of 4 troy ounces per gallon. In addition to gold, the bath may contain various other additives such as conducting salts, hardening agents, etc. Generally, the concentration of conducting salts does not exceed 10 pounds per gallon since bath with higher concentration tends to precipitate material even at elevated temperatures. These conducting salts are generally either one or more salts, particularly for example, ammonium citrate, sodium citrate, or potassium citrate. Other salts may also be used such as phosphates (e.g., $K_2HPO_4$, $KH_2PO_4$, etc). A typical gold phosphate bath has per liter 20 gms $KAu(CN)_2$, 40 gms $K_2HPO_4 \times 3H_2O$ and 10 gms $KH_2PO_4$. Small amounts of cobalt salts generally in a range of 0.001 to 2 grams per liter may be added if hard gold plating is desired. Preferred conditions for lower concentrations of gold are also shown in FIG. 1. It should be recognized that these preferred conditions include all current densities and parallel flow velocities below and to the right of the curves shown in FIG. 1. In other words, higher flow velocities or lower current densities than shown in FIG. 1 always yield highly satisfactory gold platings. Excellent quality gold platings are obtained with current densities of approximately 2000 $ma/cm^2$ and parallel flow rates above approximately 375 cm/sec.

Alloyed metals may also be plated by this method. Generally, the alloy contains at least 50 percent by weight precious metal. Particular examples are gold-copper, gold-antimony, gold-nickel, gold-silver, etc.

Other plating solutions for precious metals are described in a book edited by F. A. Lowenheim, Modern Electroplating, John Wiley and Sons, New York, 3rd Edition, 1974 especially chapters 8 and 13. Typical baths for platinum have the composition 12 gm/liter $K_2Pt(OH)_6$, 15 gm/liter KOH or 20 gm/liter $H_2PtCl_6$, 300 gm/liter hydrochloric acid. Considerable variations around the above concentrations are permitted and plating is often carried out above room temperature.

Generally, the plating temperatures should be between the freezing point and boiling point of the plating bath. Temperatures as high as 35° C or even 70° C may be required to insure complete dissolution of the components of the bath.

Although conducting salts may be added to the gold plating solution, it is preferred for various reasons to minimize the amount of such conducting salts. A concentration of conducting salts less than 3/4 pound per gallon is preferred. This insures that the geometry of the electrodes in the plating cell has a dominant effect on the distribution of current entering the surface being plated. It also insures for high concentrations of gold that the bath components remain soluble in the bath even at room temperature. This permits plating at room temperature which is much more convenient than plating at elevated temperatures. Gold-phosphate baths with concentration of $K_2HPO_4 \times 3H_2O$ between 5 and 30 gms/liter and $KH_2PO_4$ between 1 and 8 gm/liter are preferred for the above reasons. Plating solutions without conducting salts may also be used.

Figure 2:
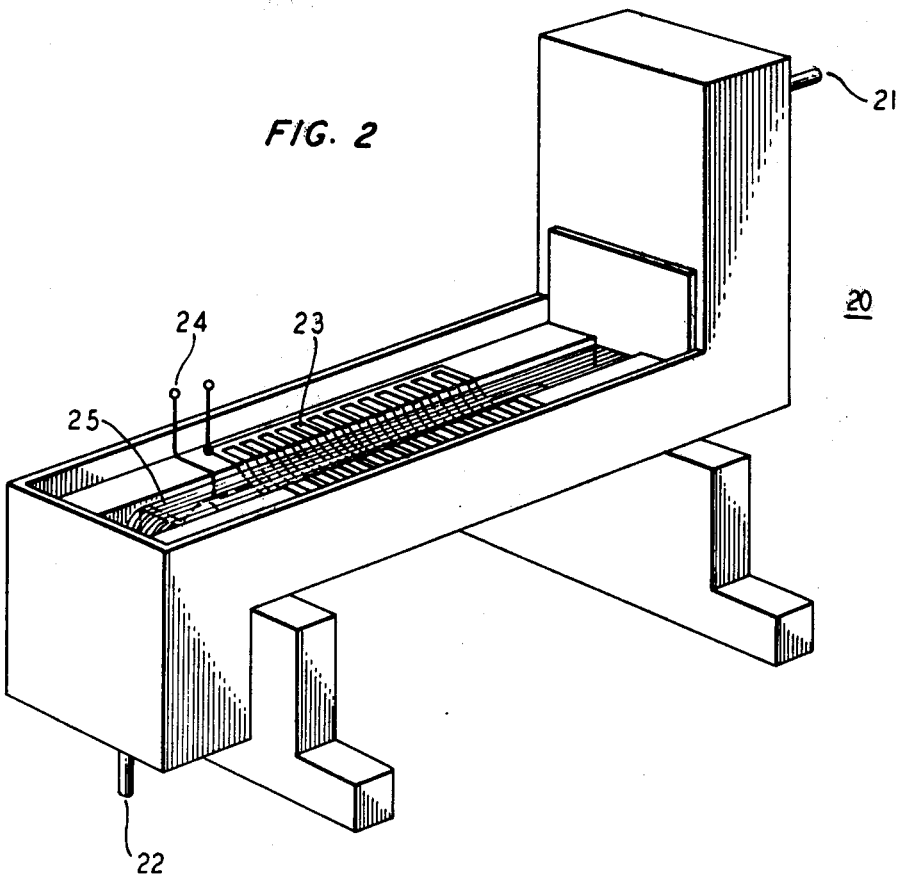
FIG. 2 shows a perspective view of a cell with surface to be plated and provisions for gravity flow of electrolyte.

A large variety of plating cell designs may be used in the practice of the invention. Of particular importance is maximization of the parallel flow rate for a given volume flow rate. A particular cell design 20 is shown in FIG. 2. This figure shows the provision for the input of gold plating bath 21 and exit for the bath 22. The fingers 23 of a connector being plated are also shown together with the provision for input of electric current 24. The flowing gold plating bath 25 is also shown.

Figure 3:
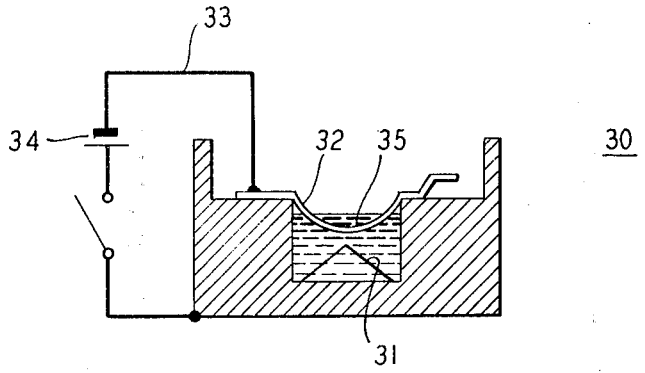
FIG. 3 shows an end view of a plating cell with surface to be plated connected to the negative pole of the power supply and anode with triangular shape below the surface to be plated.
Figure 4:
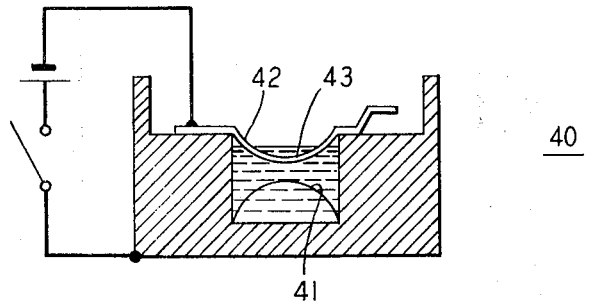
FIG. 4 shows an end view of a plating cell with surface to be plated connected to the negative terminal of a power supply and anode below the surface with a semicylindrical shape.
Figure 5:
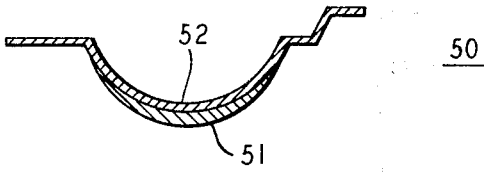
FIG. 5 shows a cross-section of a surface already plated showing the nonuniform distribution of gold.

A side view of this plating bath which shows particular shapes for the surface being plated and anode are shown in FIGS. 3 and 4. FIG. 3 shows a plating cell 30 with a triangular shaped anode 31, together with the surface being plated 32 and the electrical system 33 and electrical source 34. The shape of the anode is such as to yield a highly nonuniform gold plating with gold concentrated in the center of the surface being plated 35 and tapering off to a very thin plating towards each end. FIG. 4 shows a side view of a plating cell 40 with a semicircular-shaped anode 41 and surface to be plated 42. This electrode arrangement also yields a nonuniform plating but the variation in thickness either distance away from the center of the plating surface 43 is somewhat more gradual than in the arrangement shown in FIG. 3. A typical nonuniform plating 50 is shown in FIG. 5, which shows a typical gold plating 51 on a finger for an electrical connector 52.

Figure 6:
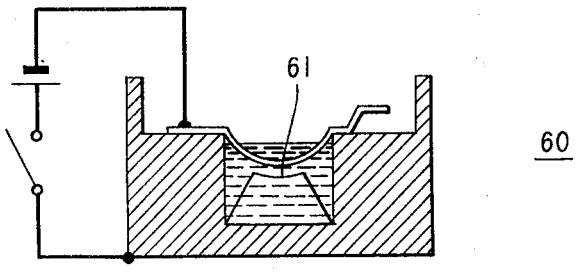
FIG. 6 shows an end view of a plating cell with surface to be plated connected to the negative pole of a power supply and anode below the surface with a cavity shape.
Figure 7:
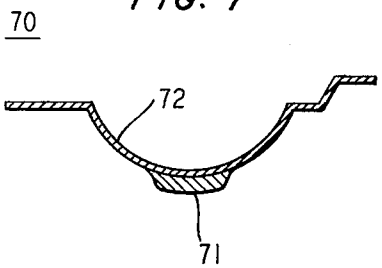
FIG. 7 shows a schematic cross-section of a surface already plated showing a region of uniform plating surrounded by a region of minimum plating.

FIG. 6 shows an end view of plating cell 60 with an alternate electrode configuration. Here, there is one area of equidistant separation 61 between electrodes surrounded by an area of much greater separation. Such a configuration yields a gold plating distribution 70 as shown in FIG. 7 with essentially uniform distribution in the middle 71 and minimum thickness outside the middle area 72.

Figure 8:
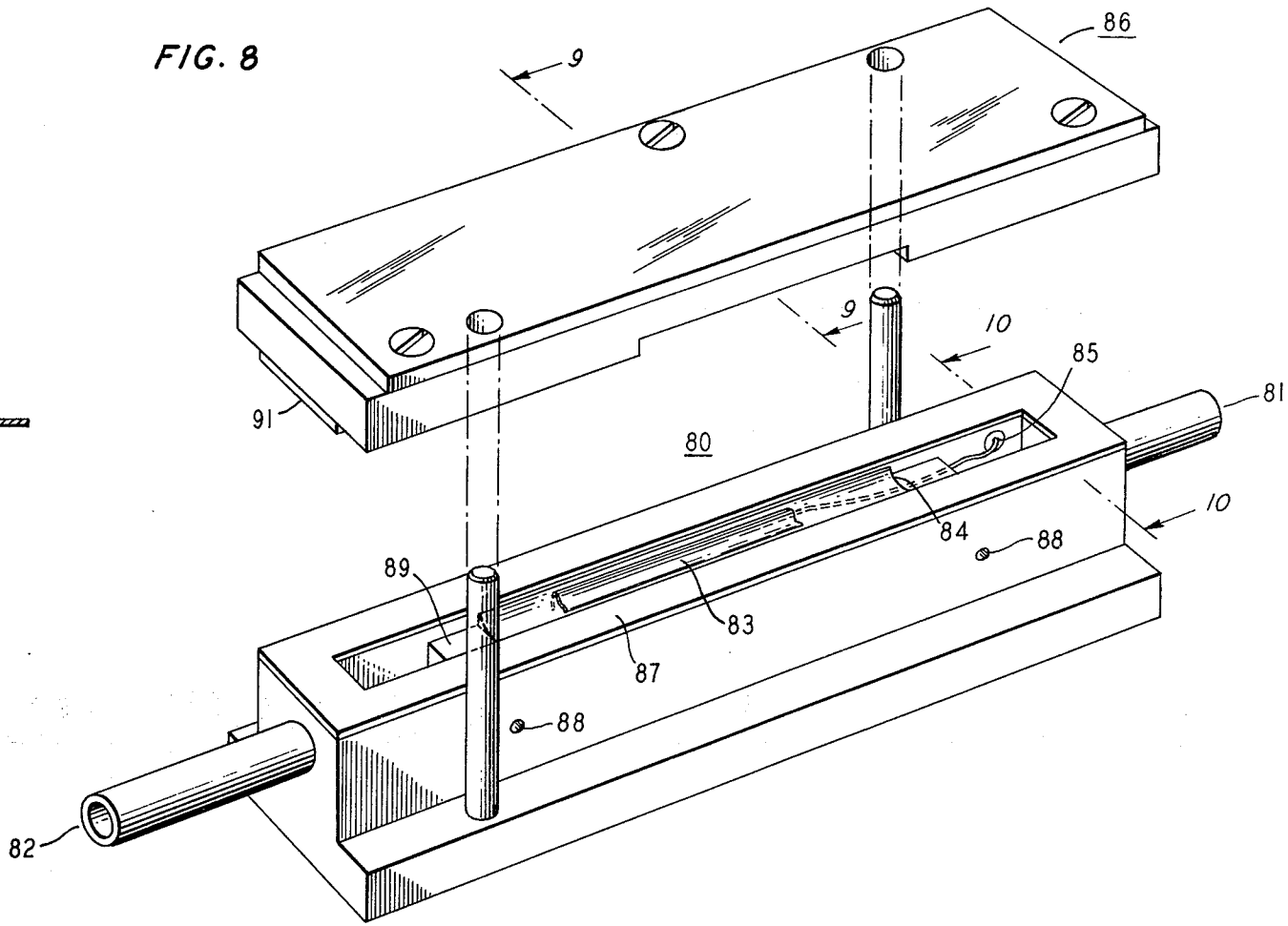
FIG. 8 shows an exploded perspective view of a particular cell design.

FIG. 8 shows another plating cell 80 design primarily to increase parallel flow rate for a given volume flow and to make replacement of anode and article being plated more convenient. Bath solution is pumped into the cell through a tube 81 and exits through a tube 82 at the other end of the cell. The anode, usually made of platinum is shown 83 connected by wire 84 to an external electrical connector 85 which during operation is connected to a power source. The surface being plated is not shown but is placed above the anode and connected to the power source. The cover 86 is used to seal in the plating bath using a sealing ring 87 and to hold in place the surface to be plated. Set screws are used to allow movement of the anode assembly up and down so as to adjust distance between anode and surface to be plated.

Figure 9:
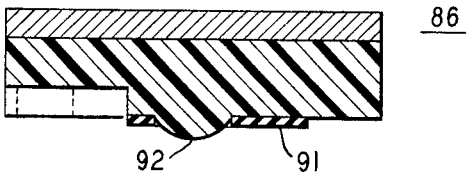
FIG. 9 shows a side view of the top plate of the plating cell shown in FIG. 8.

FIG. 9 is a side view of the cover plate 86 of the cell including sealing material 91 and rounded portion 92 to keep the surface being plated in place and reduce cross-section through which bath solution can be circulated so as to increase parallel flow velocity for given volume flow rate.

Figure 10:
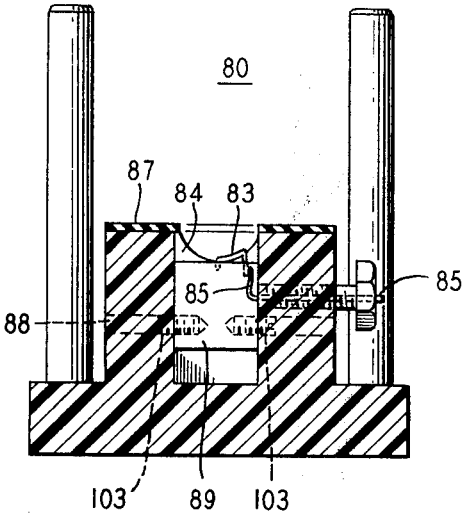
FIG. 10 shows a side view of the bottom part of the plating cell shown in FIG. 8.

FIG. 10 shows a side view 80 of the base part of the cell showing sealing material 87, electrical connection to anode, external electrical connector 85, set screws 103 to position anode assembly 89.

Figure 11:
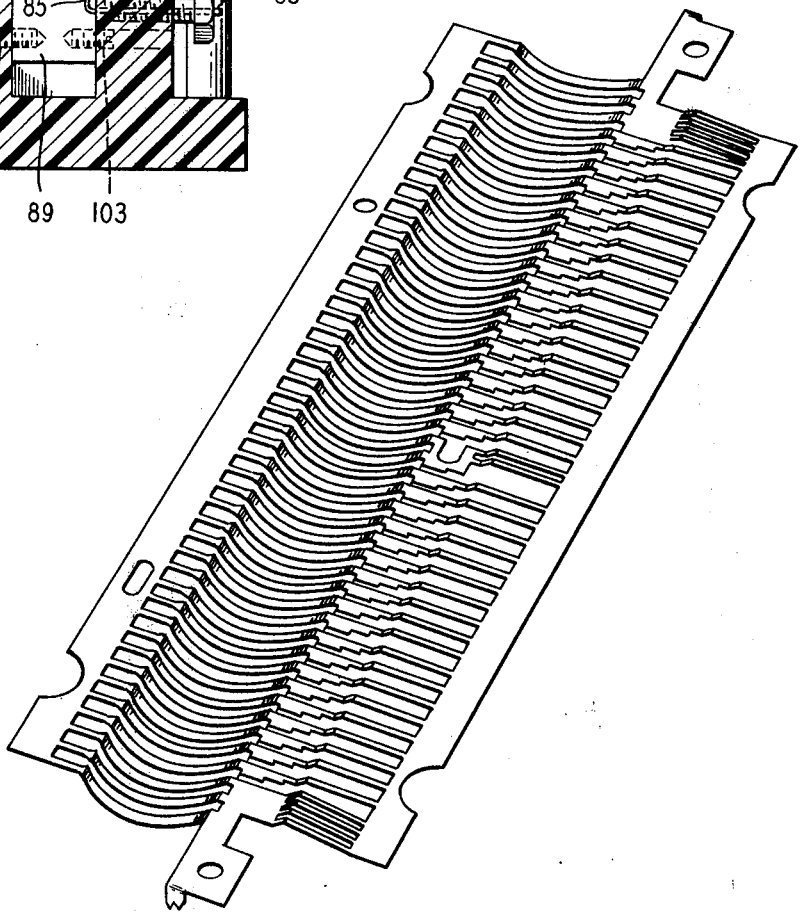
FIG. 11 shows the metallic part of multicircuit connector advantageously gold plated in accordance with the invention.

FIG. 11 shows the metallic part of a multicircuit connector which is advantageously gold plated in accordance with the inventive procedure. A spring-type metal is used such as beryllium copper or other copper alloy.

What is claimed is:

1. A process for the fabrication of articles in which a precious metal is electroplated on at least one surface comprising the steps of a. assembling a metal plating cell with an anode-cathode separation distance of a single anode and a single cathode, anode and surface to be plated;

b. pumping metal plating solution of a given composition and temperature between the freezing point and boiling point of the metal plating solution through the metal plating cell thereby producing a given parallel flow rate with anode and cathode in stationary positions;

c. passing current through electrodes of the metal plating cell at a given current density so as to plate metal onto the surface to be plated CHARACTERIZED IN THAT the minimum electrode separation distance is less than about 0.5 inches, the ratio between longest and shortest anode-cathode separation distance of a single anode and a single cathode is at least two to one; the parallel flow rate of the metal plating solution is at least 50 centimeters per second and the plating rate in terms of current density is at least 100 milliamperes per $cm^2$.

2. The process of claim 1 in which the precious metal is selected from the group consisting of gold, rhodium, palladium, iridium and platinum.

3. The process of claim 2 in which the precious metal is gold.

4. The process of claim 3 in which the electrode separation distance is between 0.050 and 0.150 inches.

5. The process of claim 3 in which the concentration of gold in the gold plating bath is 1–4 troy ounces per gallon.

6. The process of claim 5 in whichh the current density has a maximum and the parallel flow rate has a minimum given approximately by the expression current density equals 5.7 times parallel flow velocity.

7. The process of claim 5 in which the gold in the gold plating bath is in the form of a gold cyanide complex ion.

8. The process of claim 7 in which the gold is in the form of potassium gold cyanide.

9. The process of claim 8 in which the ratio between longest and shortest separation distance is at least ten to one.

10. The process of claim 5 in which the concentration of gold in the gold plating bath is 3–4 troy ounces per gallon.

11. The process of claim 5 in which the gold plating bath contains cobalt salts in the range of 0.001 to 2 grams per liter.

12. The process of claim 3 in which the gold plating is carried out at ambient temperatures.

13. The process of claim 3 in which the ratio between longest and shortest separation distance is at least five to one.

14. The process of claim 3 in which the parallel flow rate is at least 100 cm/sec.

15. The process of claim 14 in which the parallel flow rate is at least 375 cm/sec.

16. The process of claim 1 in which the plate rate expressed as current density is at least 500 $mA/cm^2$.

17. The process of claim 1 in which the plate rate expressed as current density is at least 2000 $mA/cm^2$.

* * * * *